US005097779A

United States Patent [19]

Ishikawa et al.

[11] Patent Number: 5,097,779

[45] Date of Patent: Mar. 24, 1992

[54] PATTERN SELECTING DEVICE OF AN ELECTRONIC SEWING MACHINE

[75] Inventors: Satoru Ishikawa; Akira Orii, both of Tokyo, Japan

[73] Assignee: Janome Sewing Machine Co., Ltd., Tokyo, Japan

[21] Appl. No.: 627,016

[22] Filed: Dec. 13, 1990

Related U.S. Application Data

[63] Continuation of Ser. No. 451,009, Dec. 11, 1989, abandoned.

[30] Foreign Application Priority Data

Dec. 16, 1988 [JP] Japan ..... 63-316107

[51] Int. Cl.[5] ..... D05B 3/02

[52] U.S. Cl. ..... 112/445; 112/458

[58] Field of Search ..... 112/458, 445, 444, 456, 112/457, 453, 454, 121.11, 121, 12

[56] References Cited

U.S. PATENT DOCUMENTS

| | | | |
|---|---|---|---|
| 4,181,086 | 1/1980 | Takenoya et al. | 112/445 |
| 4,512,271 | 4/1985 | Herdeg et al. | 112/445 |
| 4,660,488 | 4/1987 | Hanyu et al. | 112/458 X |
| 4,860,678 | 8/1989 | Skogward | 112/445 |
| 4,901,656 | 2/1990 | Yoshida | 112/445 X |
| 4,942,836 | 7/1990 | Sano et al. | 112/445 |

*Primary Examiner*—Peter Nerbun

*Attorney, Agent, or Firm*—Michael J. Striker

[57] ABSTRACT

A stitching pattern selecting device is disclosed which makes it possible to switch a plurality of patterns selectable among pattern groups displayed in a limited range at the front face of a sewing machine. The desired patterns are selected by scrolling large size indications of available patterns in succession so as to shorten the time for selecting the desired patterns, and select securely the patterns by a reverse white-black indication.

6 Claims, 8 Drawing Sheets

(a) RIGHT ROTATION OUTPUT (b) LEFT ROTATION OUTPUT

PATTERN SELECTING DEVICE OF AN ELECTRONIC SEWING MACHINE

This is a continuation of application Ser. No. 451,009 filed Dec. 11, 1989, now abandoned.

BACKGROUND OF THE INVENTION

The present invention relates to a pattern selecting device of an electronic sewing machine, and more particularly a device which may select easily and rapidly desired patterns from a plurality of stored patterns.

There have been proposed sewing machines which select desired patterns from a plurality of predetermined patterns stored in a memory.

For selecting the desired patterns, there has been provided means for indicating the stored patterns, means for selecting the indicated patterns and means for indicating the selected patterns.

Recently, a space for indicating the stored patterns has been widened and the number of stored patterns has been increased.

A direct selecting method is desirable for rapidly selecting the patterns without making errors by directly touching indications of the patterns. But, for showing all the stored patterns in a limited place such as a front part of the sewing machine, the displayed pattern indications were reduced in size. Consequently, it was difficult to observe the desired patterns among the shown pattern indications, and a sufficient space for improving the selection could not be obtained. Therefore, each of the pattern indications was allotted a number, and the pattern was selected according to the numbers. However, since the selection was operated not directly but indirectly, errors could easily occur.

SUMMARY OF THE INVENTION

It is an object of the invention to provide a pattern selecting device for an electronic sewing machine which enables the selection of the desired patterns by the direct indication thereof. The pattern indicating means are associated with a pattern selecting means which is actuated to designate the desired patterns so as to prevent erroneous selections.

For accomplishing this object, according to the invention, the pattern selecting device of the electronic sewing machine is composed of a pattern information memory which stores stitching pattern information about available patterns; a pattern indication memory which stores the data for indicated patterns in pattern groups corresponding to the patterns stored in the pattern information memory; a pattern indicating means including a stored pattern indicating part which indicates the pattern groups read out from the pattern indication memory; a selecting means comprising a transparent touch panel which includes a plurality of selecting parts arranged at positions corresponding to the patterns displayed on the pattern indicating means; a first pattern selecting member which selects the desired pattern groups; a second pattern selecting member which moves the desired pattern among the indicated pattern groups to a selecting position; and a reading-out means which reads out the patterns in the selecting position.

DESCRIPTION OF THE PREFERRED EMBODIMENTS

Figure 1:
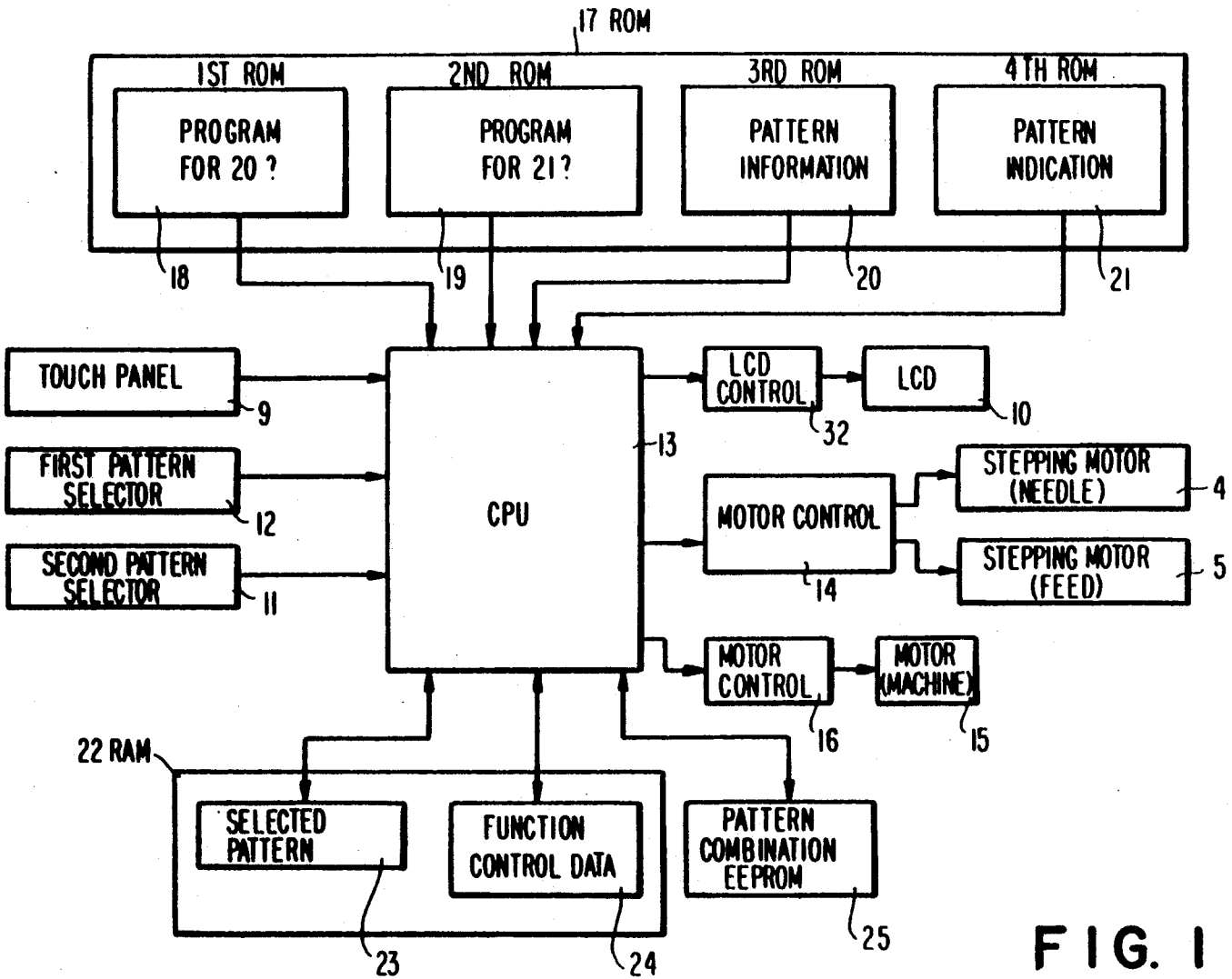
FIG. 1 is a block circuit diagram of a pattern selecting device according to the invention.

In the drawings, the reference numeral "10" indicates a liquid crystal indication plate or panel which serves as a pattern indication or read-out means, the reference numeral "11" designates an inner jog of a second pattern selecting member, the reference numeral "12" designates a shuttle of a first pattern selecting member, "20" indicates a pattern information memory, "21" a pattern indication control memory, "32" a control circuit for the liquid crystal indication plate 10, and "50" denotes a selecting signal counting means.

Figure 2:
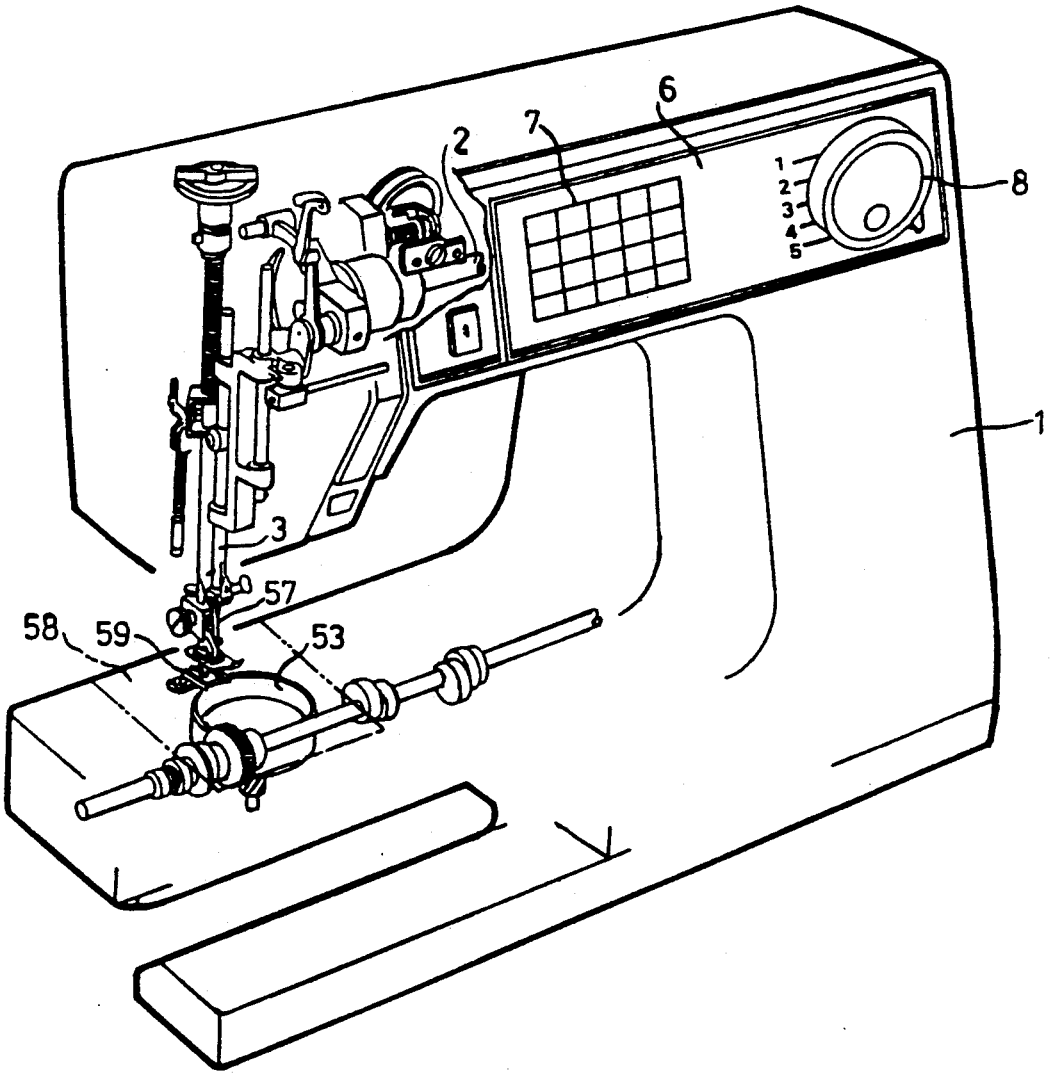
FIG. 2 is a perspective view of a sewing machine incorporated with the device of FIG. 1.

FIG. 2 shows a perspective view of a sewing machine provided with a pattern selecting device according to the present invention. A needle bar 3 is connected to an upper shaft 2 transmitting rotation from a drive part (not shown), so that it is movable laterally and vertically, and it carries a needle 57 at its end point. A needle plate 58 is fixed to the machine frame 1 at a range under the needle, and is defined with a needle dropping hole and a hole for passing a feed dog 59 back and forth crossing the lateral movement of the needle bar.

The reference numeral 53 designates a loop taker device as a needle thread catching means forming locked stitches in association with the needle 57 under the needle plate 58.

The needle bar 3 is connected to a needle amplitude stepping motor (not shown) secured to the machine frame 1, and a means for setting the back and forth movement of the feed dog 59 is connected to a feed control stepping motor (not shown) secured to the machine frame 1.

Pattern stitches are produced in a manner that the needle amplitude stepping motor is driven in synchronism with the rotation of the upper shaft 2, and the needle 57 is moved laterally as well as vertically, so that the feed control stepping motor is driven to control the back and forth movement of the feed dog 59.

The reference numeral 6 designates a front panel fixed to the front face of the machine frame 1, which is provided with a pattern selected means 7 and a jog dial 8.

Figure 3:
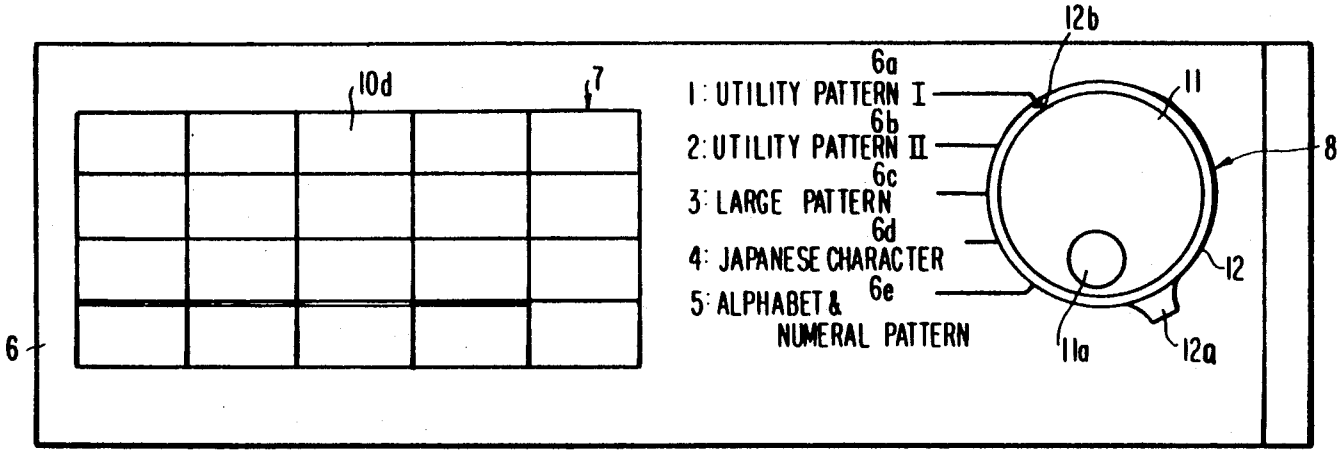
FIG. 3 is a front view of a pattern selecting means including a panel positioned in a front part of the sewing machine.

The pattern selecting means 7 is, as seen in FIG. 3, composed of a transparent touch panel 9 disposed at the upper surface of the front panel 6, and a liquid crystal indicating panel 10 adjoining the rear side of the panel 9. They are positioned such that the liquid crystal indicating panel 10 is situated at a position corresponding to selecting and detecting parts of the transparent touch panel 9.

Figure 4:
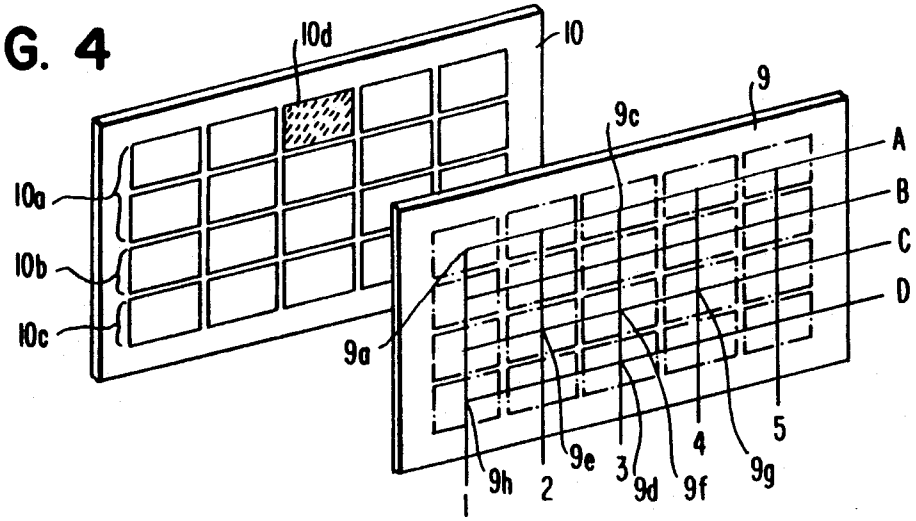
FIG. 4 is an exploded perspective view of the panel of FIG. 3.

The transparent touch panel 9 is, as shown in FIG. 4, provided with four horizontal signal lines A to D and five vertical signal lines 1 to 5, and the resulting 20 crossing points constitute selecting and detecting parts which serve as touch keys. Thus, for example, 9*a* is a crossing point of the horizontal signal line A and the vertical signal line 1, and if this crossing point 9*a* is operated, a signal A1 is selected.

Figure 10:
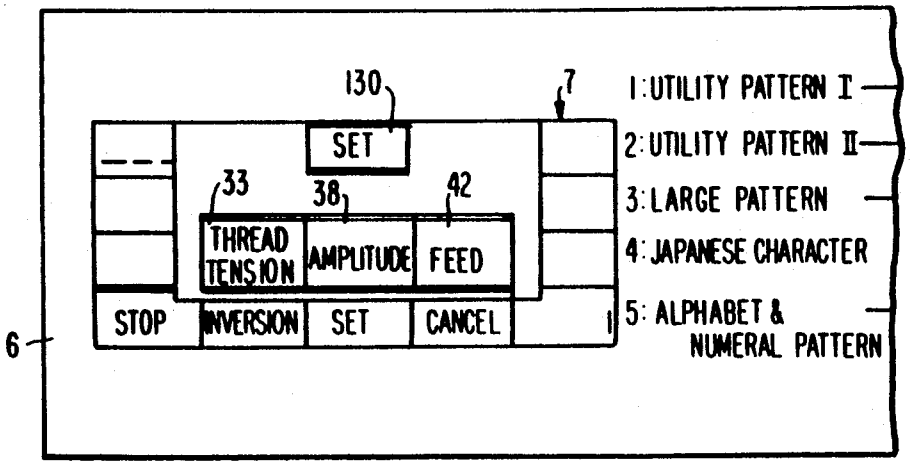
FIG. 10 is a view for explaining a liquid crystal indication panel window indicating "Set" mode.

The liquid crystal indicating panel 10 is, as seen in FIGS. 3 and 4, formed with a stored pattern indicator 10*a* for indicating the stored patterns in pattern groups, a selected pattern indicator 10*b* for indicating the selected patterns, and a function selecting indicator 10*c* for altering and setting the stitching functions when the patterns are selected. When the function selecting indicator is operated, the pattern is indicated in the window as shown in FIG. 10.

The stored pattern indicator 10*a* has a selecting position 10*d* at its center, and the indicated patterns scrolled by the selection are indicated in a reverse white-black image.

Figure 5:
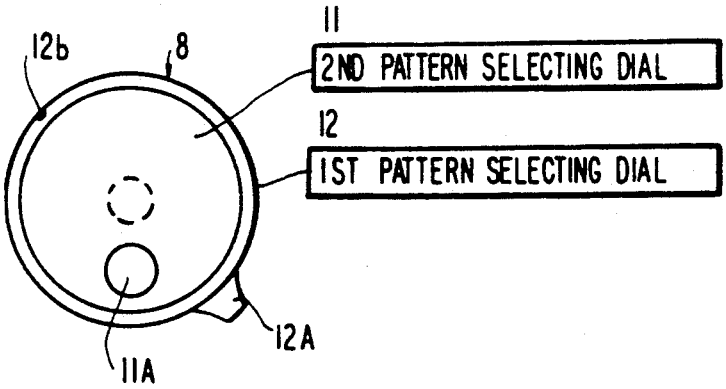
FIG. 5 is a front view of a jog dial.

The jog dial 8 shown in FIG. 5 comprises an outer shuttle 12 acting as a 1st pattern selecting member which is rotatably supported on the front panel 6, and an inner jog 11 acting as a 2nd pattern selecting member.

The inner jog 11 or the end pattern selecting member has a finger operated concave area 11*a* on its surface, and the shuttle 12 of the 1st pattern selecting member has a finger operated projection 12*a* on its outer circumference. Diametrically opposite the projection 12*a*, the shuttle 12 is formed with an index mark 12*b*. The front panel 6 is provided with marks 6*a* to 6*e* each pertaining to one of the pattern groups which indicate "Utility Pattern I", "Utility Pattern II", "Large Pattern", "Japanese Character" and "Alphabet & Numeral" pattern in accordance with stopping positions of the index mark 12*b*.

Figure 6:
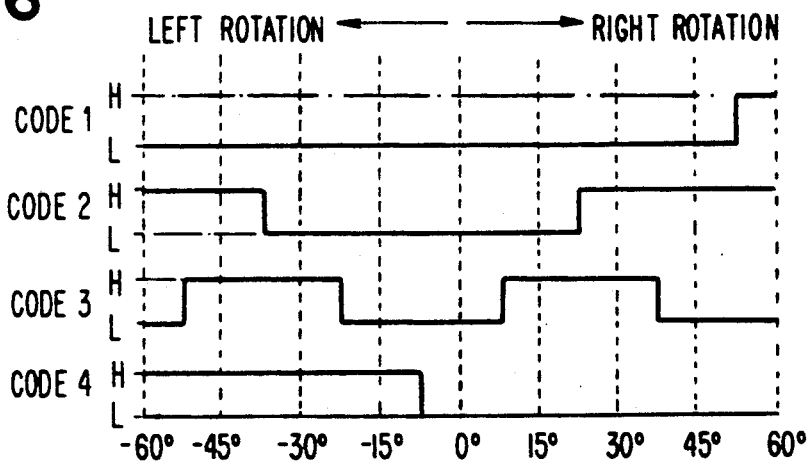
FIG. 6 is a plot diagram of output wave shapes issued from a first pattern selecting member.

The shuttle 12 of the 1st pattern selecting member is set into a stopping position per each 15° with respect to a 0° stopping position by means of the rotation either within the left rotation range of 60° or the right rotation range of 60° and, as shown in FIG. 6, issues coded signals derived from CODE1 and CODE4 so as to detect the selecting position information.

As seen from FIG. 6, CODE1 assumes H level only at the 60° position of the right rotation, and L level of the other positions. CODE2 is H level at the 45° and 60° positions of the left rotation and at the 30°, 45° and 60° positions of the right rotations, and L level at the other positions. CODE3 is H level at the left rotation positions 45° and 30° and at the right rotation positions 15° and 30°, and L level at the other positions. CODE4 is H level at the left rotation positions between 60° and 15°, and L level at the other positions.

Accordingly, at the left rotation position 60°, CODE1 is L, CODE2 is H, CODE3 is L and CODE4 is H, and the CODE signals "L, H, L, H" show the left rotation position 60°. At the left rotation position 45°, the CODE signals are "L, H, H, H" and at the left rotation position 30°, the CODE signals are "L, L, H, H". In this manner, the remaining selecting positions are detected.

Figure 7:
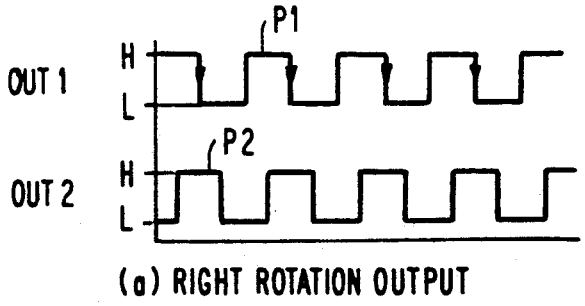
FIG. 7 is a plot diagram of output wave shapes when a second pattern selecting member is rotated in a right direction.
Figure 8:
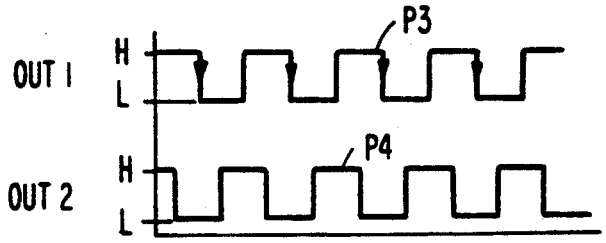
FIG. 8 is a plot diagram of output wave shapes when the second pattern selecting member is rotated in a left direction.

The jog 11 outputs at outputs OUT1 and OUT2 the CODE signals P1, P2 or P3, P4 with a phase shift therebetween as shown in FIGS. 7 and 8.

The phase shift in FIG. 7 shows that the jog 11 is rotated rightwards, while the phase shift in FIG. 8 shows that it is rotated leftwards. The horizontal line shows the rotation amount of the jog, and the vertical line shows the level of the CODE signal. The rotating direction is determined in dependence upon whether the level of CODE signals P2 or P4 at OUT2 is H or L at the time of level H of CODE signals P1 or P3 at OUT1. The right rotation is determined when the level at OUT2 is H level, and the left rotation is determined when the level at OUT1 is L level. Since the length of the CODE signal is altered by rotating the jog 11, the amount of scrolling of the patterns is set by the length of the CODE signal.

A pattern selecting device of the sewing machine will be explained.

In FIG. 1, the reference numeral 13 designates a central processing unit which is connected with the transparent touch panel 9, the jog 11 serving as the 2nd pattern selecting member, and the shuttle serving as the 1st pattern selecting member, and further connected with the needle amplitude stepping motor 4 and the feed control stepping motor 5 via a stepping motor drive control circuit 14.

The liquid crystal indicating panel 10 is connected to the central processing unit 13 via a liquid crystal indication control memory 32 which is composed of a video random access memory VRAM such as, for example LH5164-15 of Sharp Co. Ltd., which temporarily stores the pattern information to be indicated in the liquid crystal indicating panel 10.

The machine motor 15 is connected to the central processing unit 13 via a motor drive control circuit 16.

Read-only memory ROM 17 is composed of a system program memory 18, (a 1st ROM) for the reading-out of pattern information selected by the transparent touch panel 9, a system program memory 19 (a 2nd ROM) concerning switching data for an indication on the liquid crystal indicating panel 10, a stitching pattern information memory 20 (a 3rd ROM) including the stitch forming data, and a pattern indication data memory 21 (a 4th ROM), which are connected to the central processing unit 13.

Random access memory RAM 22 is composed of a selected pattern memory 23 (a 1st RAM), and a function controlling information memory 24 (a 2nd RAM), which are connected to the central processing unit 13.

EEPROM 25 is a memory means which is able to electrically write in the data and does not require a holding power source and is connected to the central processing unit 13 to serve as a pattern combination memory.

A further explanation will be made to a pattern selection. The liquid crystal indicating panel 10 indicates, upon turning on the electric power source, the pattern groups selected by the shuttle 12. That is, the position where the index mark 12*b* meets a desired indication mark, e.g. 6*a*, determines that a corresponding pattern group, e.g. "Utility Pattern I" is selected the signals from CODE1 to CODE4, and the switching information concerning "Utility Pattern I" is read out from the system program memory 19 (the 2nd ROM). This switching information includes a first signal for reading out the information from the system program memory 18 (the 1st ROM) and a second signal for reading out the information from the pattern indication data memory 21 (the 4th ROM).

Figure 9:
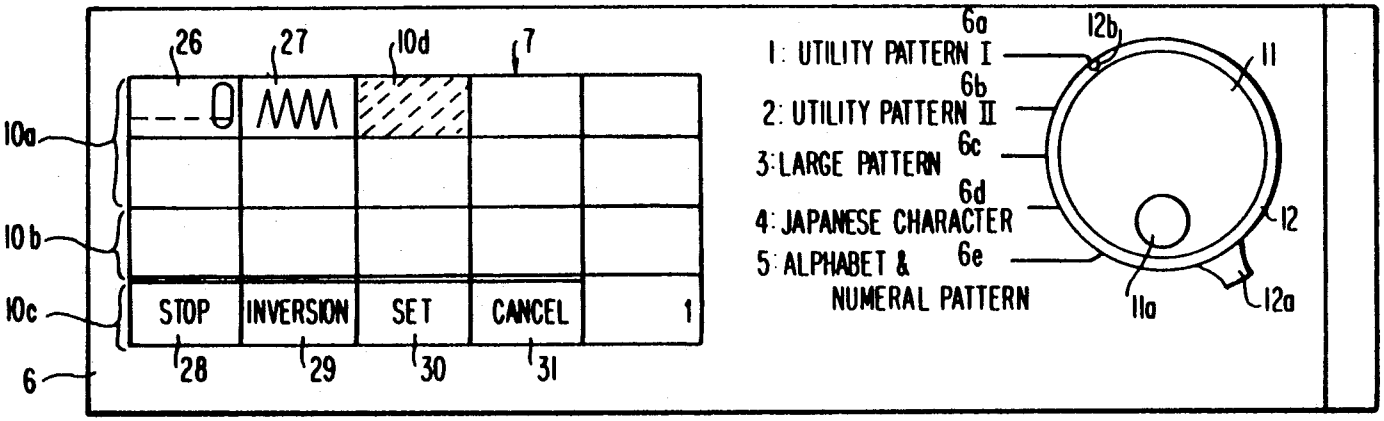
FIG. 9 is a view for explaining a liquid crystal indication panel showing "Utility Pattern I"

The indication data of "Utility Pattern I" is read out from the indication data memory 21 by means of the second signal from the 2nd ROM, and the pattern is indicated in the liquid crystal indicting panel 10 as shown in FIG. 9, and the reading-out data of the transparent touch panel 9 is set in response to "Utility Pattern I".

In FIG. 9, utility patterns other than a straight pattern 26 and a zig-zag pattern 27 are indicated in the stored pattern indicating part 10*a*. A selected function indicating part 10*c* indicates "Stop " 28 for designating a stop stitch, "Inversion " 29 for designating the inversion of the pattern, "Set" 30 for designating adjustments and of the selected pattern, and "Cancel" 31 for cancelling the designations.

An explanation will be made to a case that "Zigzag" 27 is selected among the patterns indicated in the stored pattern indicator 10*a*.

A selection indicating position 10*d* is set at the center of the stored pattern indicating part 10*a*, and is shown the reversed white - black indication.

A desired pattern is moved to the selection indicating position 10*d* by rotating the jog 11.

In FIG. 9, since "Zigzag" 27 is positioned leftwards from the selection indicating position 10*d*, the jog 11 is rotated rightwards, so that the pattern groups are scrolled in succession to the right by means of the CODE signal at OUT2 generated during the rotation of the jog 11.

When the pattern "Zigzag" 27 is stopped at the scrolling position 10*d* it means that the pattern has been selected. A signal of the selected pattern indicated in the selection indicating position 10*d* is output from the pattern information memory 20 into the liquid crystal indication control memory 32.

When the selected pattern signal outputs a zigzag pattern, various kinds of data which are predetermined and stored in the pattern information memory means 20 are output to control the forming of the pattern. When the data are not altered, the machine motor 15 is rotated by operating a machine starting means (not shown). Then, the upper shaft 2 is rotated in synchronism with the vertical movement of the needle 57, and the needle amplitude stepping motor and the feed control stepping motor are actuated with the data read out from the pattern information memory 20 so as to produce the predetermined zigzag patterns.

An explanation will be made in a case when the predetermined data are to be altered. If operating the transparent touch panel 9 by touching the "Set" 30 of the function selecting indicating part 10*c*, the selection detecting point 9*d* for the "Set" 30 being D - 3 in FIG. 4, an indicating signal for altering to "Set" ode is generated.

The switching information concerning the "Set" mode is read out from the system program memory 19 (the 2nd ROM). This switching information includes an indication signal containing a first signal for reading out the key reading-out data of the transparent touch panel 9 from the system program memory means 18 (the 1st ROM) and a second signal for reading out the indicting data from the indication data memory 21 (the 4th ROM).

By means of the indication signal, the indicating data is output to the liquid crystal indicating panel 10 so as to window-indicate the corresponding mode as shown in FIG. 10, and a key reading-out data is determined in response to the key indication in the window-indication.

In FIG. 10, the reference numeral 130 designates a "Set" mode which shows a present setting state (a selection detecting part 9*c* of the transparent touch panel 9 being A3 in FIG. 4) and a signal for designating return to a previous pattern indication is generated.

The numeral 33 indicates "Thread Tension" (a corresponding selection detecting point 9*e* of the transparent touch panel 9 being C - 2 in FIG. 4), which upon actuation outputs an indication signal for altering a thread tension of a non-illustrated, known electric thread tension device after switching to "Setting Thread Tension" mode.

The switching information concerning the "Setting Thread Tension" mode is read out from the system program memory 19 (the 2nd ROM) with respect to the indication signal. As described above, the switching information includes an indication signal containing a first signal for reading out the reading-out data of the transparent touch panel 9 from the system program memory means 18 and a second signal for reading out the information from the indicating data memory 21.

Figure 11:
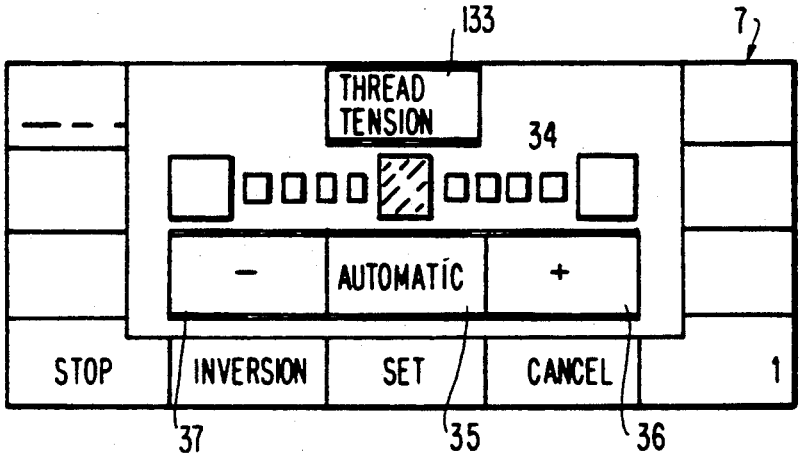
FIG. 11 is a view for explaining a liquid crystal indication panel window indicating "Thread Tension" mode.

The indicating data is output to the liquid crystal indicating control memory 32 so as to indicate the corresponding window on the liquid crystal indicating panel 10 as shown in FIG. 11, and a key reading-out data is determined in response to the key in the window-indication.

The numeral 133 designates "Thread Tension" Mode, showing a present state (a corresponding selection detecting point 9*c* of the transparent touch panel 9 being A - 3 of FIG. 4), and upon actuation an indication signal for altering the "Set" Mode of FIG. 10, is generated.

The numeral 34 designates a level meter which includes a plurality of horizontally aligned indications showing the setting state of the thread tension, whereby the right end shows the strongest thread tension, and the left end shows the weakest one, and the set position is displayed with the reverse white - black indication. The numeral 35 represents "Automatic" mode for setting a predetermined thread tension with respect to stitching conditions, (a selection detecting point 9*f* of the transparent touch panel 9 is C-3 in FIG. 4), and upon actuation a signal for designating the automatic thread tension is output, the electric thread tension device is set to the automatic thread tension, and the indication "Automatic" 35 disposed at the center of the level meter 36 is shown in reverse white - black.

The numeral 36 denotes the "+" indication, (the corresponding selection detecting point 9*g* of the transparent touch panel 9 is C - 4 of FIG. 4) for outputting a signal to set the thread tension to be strong, and the indication 34 of the liquid crystal is moved rightwards in succession by operating the electric thread tension device.

The numeral 37 denotes the "—" indication, (the corresponding selection detecting point 9*e* of the transparent touch panel 9 is C - 2 of FIG. 4) for outputting a signal to set the thread tension to be weak, and the indication 34 of the liquid crystal is moved leftwards in succession by operating the electric thread tension device.

When the alteration of the thread tension is finished, and if operating the selection detecting point of the transparent touch panel 0 on "Thread Tension" Mode 133, a signal is output for designating return to "Set" Mode indication on the screen. The set value of the thread tension is stored in the function controlling information memory 24 (the 2nd RAM).

In FIG. 10, the numeral 38 designates "Amplitude" (the corresponding selection detecting part 9*f* of the transparent touch panel 9 is C - 3 of FIG. 4), and upon actuation a signal is output for indicating alteration to "Setting Amplitude" for controlling the amount of a maximum amplitude of the needle determined for the patterns.

The switching information concerning "Setting Amplitude" mode is read out from the system program memory 19 (the 2nd ROM).

This switching information again includes a first signal for reading out the reading-out from the system program memory 18 (1st ROM) data of the transparent touch panel 9 and a second signal for reading out the information from the indicating data memory 21.

Figure 12:
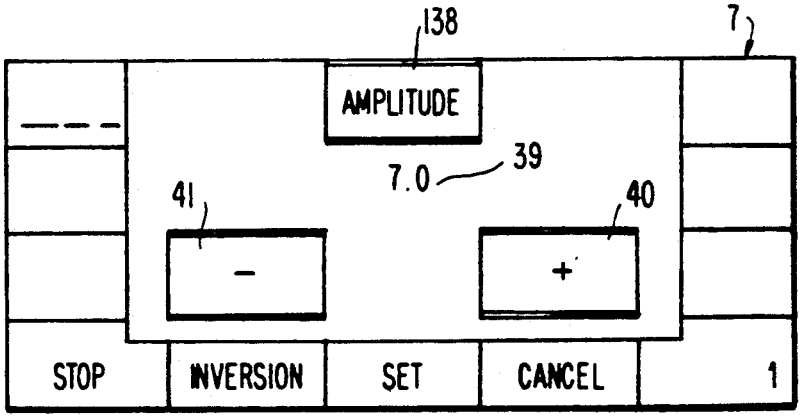
FIG. 12 is a view for explaining a liquid crystal indication panel window-indicating "Amplitude" mode.

The indicating data is output to the liquid crystal indication control memory 32 so as to window-indicate the information in the liquid crystal indicating panel 10 as shown in FIG. 12, and a key reading-out data is determined in response to the key indication in the window-indication.

The numeral 138 in FIG. 12 denotes an "Amplitude" Mode indication, showing a present set state (a corresponding selection detecting point 9*c* of the transparent touch panel 9 is A - 3 of FIG. 4), and upon actuation of the point 9*c* an indication signal of returning to "Set" Mode of FIG. 10 is generated.

The numeral 39 denotes the digital indication of the set state of the amplitude value.

The "+" indication 40, (the corresponding selection detecting point 9*g* of the transparent touch panel 9 is C - 4 in FIG. 4) serves for outputting a signal to set the amplitude to be large by increasing the amplitude value by 0.5 mm per each operation.

The "—" indication 41, (the corresponding selection detecting point 9*e* of the transparent touch panel 9 is C - 2 in FIG. 4) serves for outputting a signal to set the amplitude to be small by decreasing the amplitude value by 0.5 mm per each operation.

When the alteration of the amplitude is completed, and after operating the selection detecting point 9*c* of the transparent touch panel 9 pertaining to the "Amplitude" Mode indication 138, a signal is output for designating return to "Set" Mode indication in the LCD panel. The set value of the thread tension is stored in the function controlling information memory 24 (the 2nd RAM).

In FIG. 10, the numeral 42 designates "Feed", (the corresponding selection detecting point 9*g* of the transparent touch panel 9 is C - 4 of FIG. 4), and a predetermined amount is set to a desired feeding amount similarly as in the control of the above described "Amplitude" indication. .

If operating the selection detecting point of the transparent touch panel 9 on "Set" Mode 130 after having finished various kinds of controls, the operation is returned to the pattern selection of FIG. 9.

The machine motor 15 is rotated by operating the machine starting means (not shown). Then, the upper shaft 2 is rotated in synchronism with the vertical movement of the needle 57, and the needle amplitude stepping motor and the feed control stepping motor are actuated with the data read out from the pattern information memory 20 (the 3rd ROM) and the data read out from the function controlling information memory 24 so as to produce an adjusted zigzag pattern.

A further explanation will be made for a case that "Alphabet & Numeral" are selected by operating the shuttle 12 of the 1st pattern selecting means.

When the index mark 12*b* of the shuttle 12 is rotated to be opposite the mark 6*e* "Alphabet & Numeral" pattern indicated in the front panel 6, the "Alphabet & Numeral" pattern group is selected by the CODE signal, and the switching information concerning the "Alphabet & Numeral" pattern group is read out from the system program memory.

This switching information includes again a first signal for reading out the information from the system program memory 18, and a second signal for reading out the information from the indication data memory 21.

Figure 13:
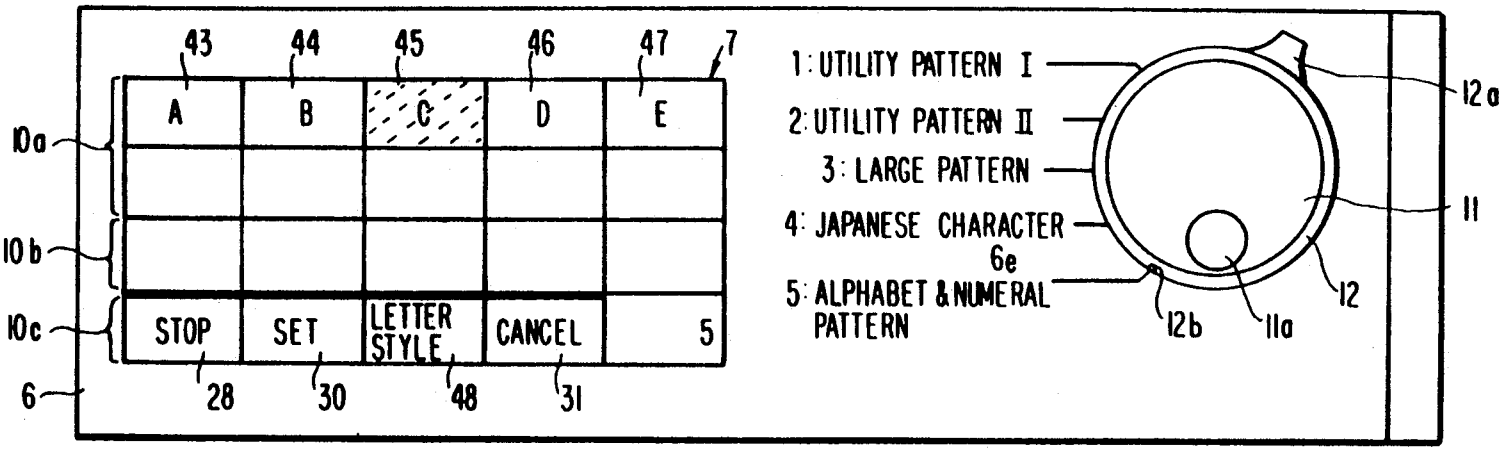
FIG. 13 is a view for explaining a liquid crystal indication panel window-indicating "Alphabet and Numeral Letters" mode.

The indicating data of "Alphabet & Numeral" pattern group is read out from the indicating data memory 21 by the second signal, and the pattern as seen in FIG. 13 is indicated in the liquid crystal indicating panel 10, and the reading-out data of the transparent touch panel 9 are set according to the "Alphabet & Numeral" pattern group.

In FIG. 13, other alphabet letters and the numerals are indicated in the stored pattern indicating part 10*a* in addition to the illustrated "A" 43, "B" 44, "C" 45, "D" 46 and "E" 47. A function selecting indicating part 10*c* at the bottom of the LCD screen indicates "Stop" 28 for designating a stop stitch, "Set" 30 for designating the adjustments and various kinds of controls, "Letter Style" 48 for designating alterations of letter styles, and "Cancel" 31 for cancelling designations.

With respect to "Stop", "Set" and "Cancel", the same operational steps may be applied to as described above when "Utility Pattern I" is selected.

The selection detecting point 9*d* on the transparent touch panel 9 for the indication "Letter Style" 48 is D - 3 of FIG. 4, which upon actuation outputs an indication signal for altering the letter styles. A switching information concerning "Setting Letter Style" is read out from the system program memory 19.

This switching information again includes a first signal for reading out the reading-out data of the transparent touch panel 9 from the system program memory 18, and a second signal for reading out the indicating data from the indication data memory 21.

Figure 14:
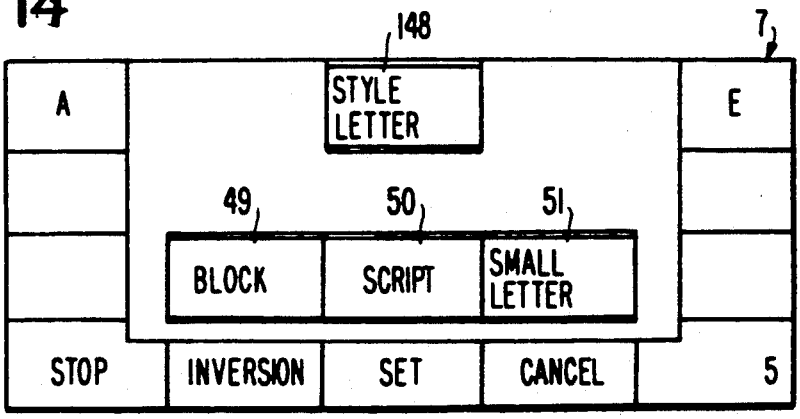
FIG. 14 is a view for explaining a liquid crystal indication panel window-indicating "Letter Style" mode.

The indicating data which is output to the liquid crystal indication control memory 32 is window-indicated in the liquid crystal indicating panel 10 as seen in FIG. 14, and the key reading-out data are set in response to the key reading-out in the window-indication.

The numeral 148 in the image plane denotes the "Letter Style" Mode, showing a set state, and upon actuation of the corresponding selection detecting point 9*c* of the transparent touch panel 9 (A - 3 of FIG. 4), an indication signal is generated to rest the pattern selection.

In FIG. 14, the numeral 49 designated "Block" letter style, and the corresponding selection detecting point 9*e* of the transparent touch panel 9 is C - 2 of FIG. 4 which upon actuation causes the letter styles to be in a block style. The numeral 50 designates "Script" letter style, and upon actuation of a corresponding selection detecting point 9*f* (C-3 of FIG. 4) the letter styles are set to be a script style.

The numeral 51 designates "Small letter", the selection detecting point 9*g* of the transparent touch panel 9 is C - 4 of FIG. 4 which determines the style to be a small letter style when actuated. If operating the transparent touch panel 9 on "Letter style" Mode 148, the determined letter style is stored in the function adjustment information memory 24 (the 2nd RAM), and is returned to the image plane of the pattern selection of FIG. 13.

An explanation will be made as to an example of combining the letters ABCD and storing them.

The shuttle 12 of the 1st pattern selecting means is operated to select the pattern groups belonging to an initial pattern of the combined patterns and indicate the patterns groups including an initial letter "A" as shown on the liquid crystal indication panel 10 in FIG. 13.

If operating the transparent touch panel 9 on the pattern indicator 10*a*, the selection detecting point 9*a* senses this operation and a CODE signal pertaining to the indicating position A-1 is generated.

This CODE signal determines to select and store the pattern "A" indicating the indicating position stored in the liquid crystal indication controlling memory 32, and this information is stored in the selected pattern memory 23 (the 1st RAM) and indicated in the selected pattern indicating part 10*b*.

The pattern group belonging to patterns to be subsequently stored is indicated in the stored pattern indicating part 10*a* of the liquid crystal indication panel 10 by operating the shuttle 12. Patterns to be subsequently combined are selected by operating the selection detecting point of the transparent touch panel 9 pertaining to the pattern indicated in the stored pattern indicating part 10*b*.

The selection detecting point senses the operation and outputs a CODE signal for determining the indicating position. The CODE signal causes to select and store the pattern indicated in the indicating position stored in the liquid crystal indication controlling memory 32, and this information is stored in the selected pattern memory 23 (the 1st RAM), and indicated in the selected pattern indicating part 10*b*, following the previous patterns.

If finishing the selection and combination of all the desired patterns, and operating the starting means (not shown) of the sewing machine, the machine motor 15 is rotated and the upper shaft 2 is driven.

The patterns are read out in an order of storing in the selected pattern memory 23, and the needle amplitude stepping motor and the feed control stepping motor are driven by operating in synchronism with the vertical movement of the needle 57 to produce the combined patterns with respect to the read-out pattern from the pattern information memory 20 (the 3rd ROM).

The indicated contents of the selected pattern indicating part 10*b* are confirmed after having stored the combined patterns. The selection detecting point 9*h* of the transparent touch panel O on "Stop" 28 is D - 1 of FIG. 4, and if operating it, the stop stitch is added to the last combined pattern and stored in the combined pattern memory 25.

The combined patterns are subject to a condition that they are not selected in the selected pattern indicating part 10*b*. The combined patterns are read out from the combined pattern memory 25 by the operation of "Inversion" in "Utility Pattern I" and the operation of the selection detecting point of the transparent touch panel 9 on "Letter Style" in "Alphabet & Numeral" Mode.

In the above mentioned first embodiment, the selecting position 10*d* indicating the pattern by the reverse white-black indication is provided in the stored pattern indication 10*a* within the liquid crystal indicting panel 10, and the pattern groups selected by the shuttle 12 of the 1st pattern selecting means are moved by the jog 11 of the 2nd pattern selecting means, and the desired patterns are positioned at the selecting position 10*d* in the stored pattern indicator 10*a*, whereby the patterns are selected by reading out the pattern of the liquid crystal indication control memory 32 which stores the patterns to be indicated in the liquid crystal indicating panel 10.

A further reference will be made to a second embodiment of the invention. In the second embodiment, a particular selecting position is not provided in the stored pattern indicating part 10*a*, and the patterns are not moved. The desired patterns are indicated in the white-black by moving the reverse white-black indication through the operation of the jog 11 of the 2nd pattern selecting means.

Other composing elements and actuations in this second embodiment are the same as those of the first embodiment, and the explanations will be omitted.

In the first and second embodiments, the patterns are indicated by the jog 11 of the 2nd pattern selecting means or moving the white-black changing indication and are read out.

A reference will be made to a third embodiment of the invention.

In the third embodiment, arrangements of the pattern groups to be selected by the shuttle 12 of the 1st pattern selecting means are predetermined and stored, the length of the signal determined by moving the jog 11 is counted and the indicated patterns and the arranged patterns are compared with the counting number when selecting the patterns.

Figure 15:
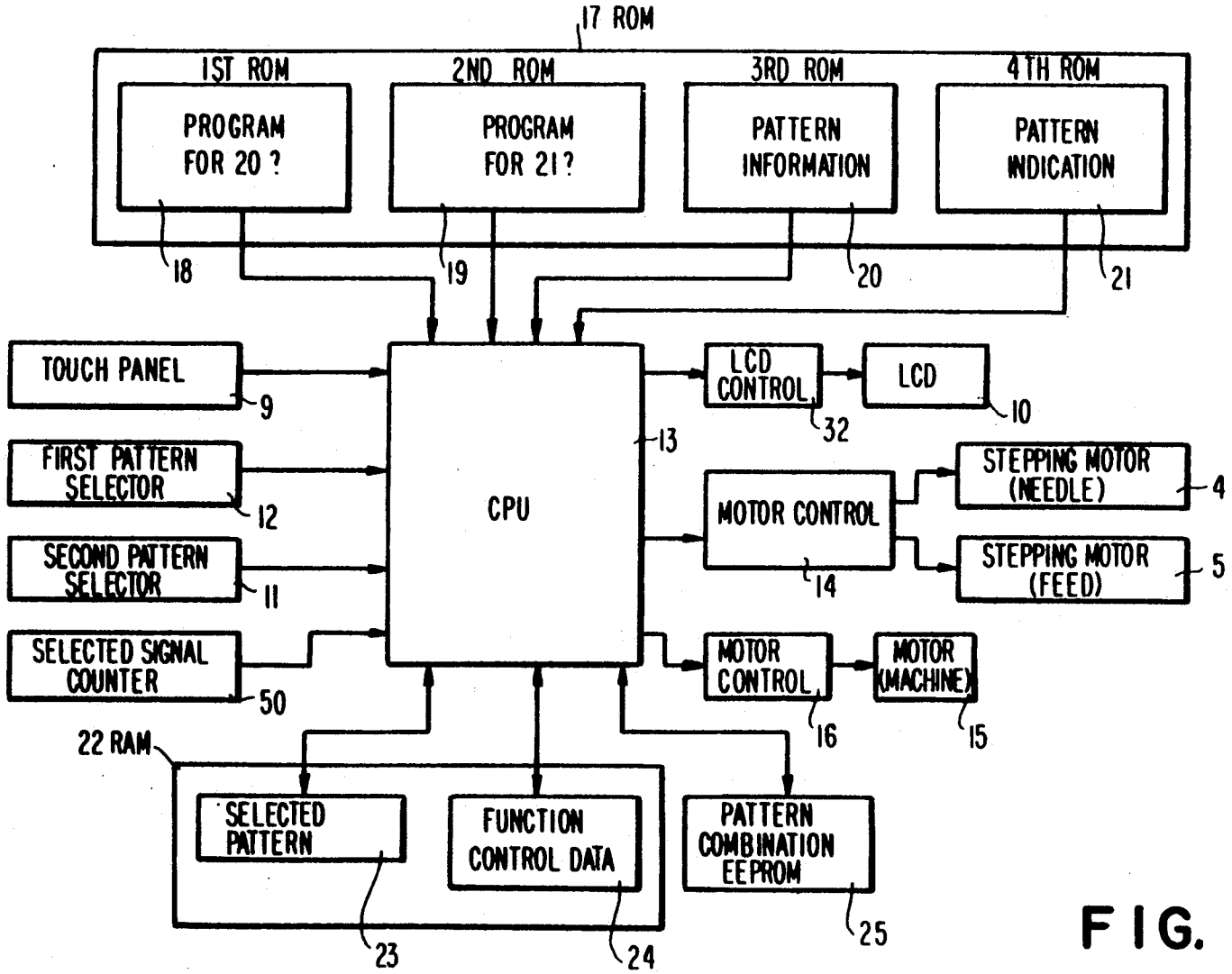
FIG. 15 is a block circuit diagram of a modification.

That is, as shown in FIG. 15, the selected signal counting means 53 for counting the length of the signal determined by the operation of the jog 11 is connected to the central processing unit 13 so as to predetermine and store the arrangements of the patterns stored in the pattern information memory 20 (the 3rd ROM) as well as predetermine and store the arrangements of the patterns stored in the indication data memory means 21 (the 4th ROM).

The pattern groups are moved by the signal generated by operating the jog 11, similarly to the first embodiment, so that the desired patterns are moved to the selecting position of the stored pattern indicating part 10*a* for showing them in the reverse white-black indication.

The selected signal counting means 53 counts the direction and the amount of the signal for detecting the patterns selected by moving the jog 11 from the initially set position.

Since other composition elements and actuations are the same as those of the first embodiment, an explanation thereabout will be omitted.

In the first to third embodiments, the desired patterns are selected by operating the jog 11 of the 2nd pattern selecting means from the pattern group selected by the shuttle 12 of the 1st pattern selecting means, and in a case of combining and storing the patterns, the desired patterns are stored by operating the transparent touch panel 9 on the stored pattern indicating part 10*a*.

Figure 16:
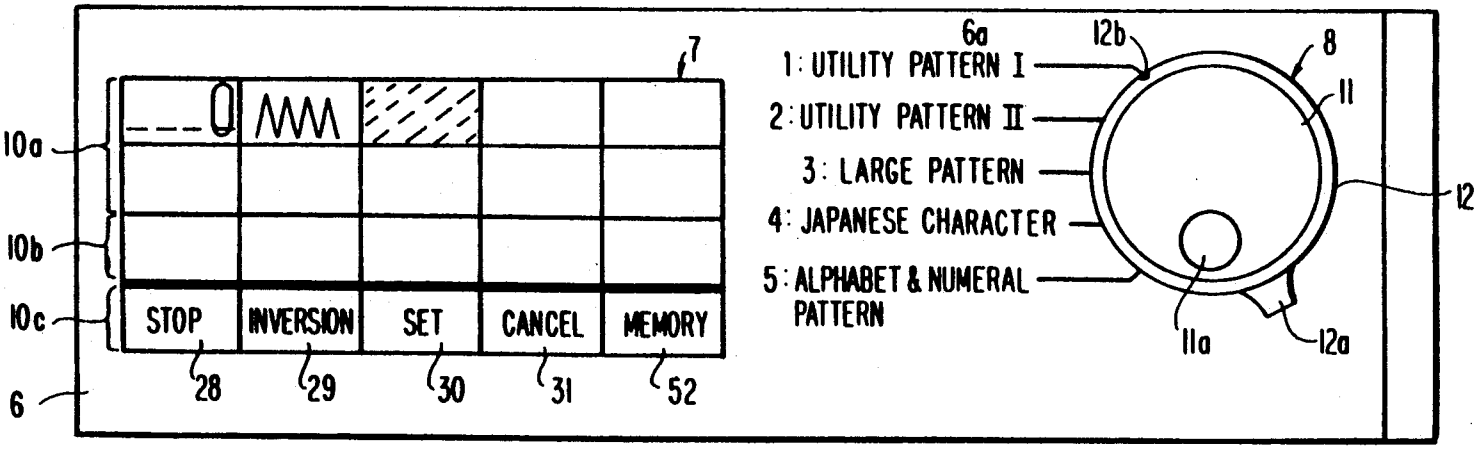
FIG. 16 is a view for explaining a modified liquid crystal indication plate window-indicating "Utility Pattern I" mode.

In the fourth embodiment, as shown in FIG. 16, "Memory" 52 is provided for storing the selected patterns in the function selecting indicating part 10*c* of the liquid crystal indication panel 10 by an operation subsequent to the selection of the patterns. The pattern is directly selected by operating the transparent touch panel 9 on the stored pattern indicating part 10*a*.

I claim:

1. A pattern selecting device for an electronic sewing machine, comprising a pattern information memory which stores stitching pattern information about available patterns; an indication data memory which stores indicated groups of patterns according to the patterns stored in the pattern information memory; a pattern indication means including a stored pattern indicating part which indicates the pattern groups read out from the indication data memory; a first pattern selecting member which effects selection of a pattern group to be indicated in the pattern indicating means; a second pattern selecting member which effects movement of pictorial representation of desired patterns from a selected pattern group to a selecting position; and a reading-out mean which reads out the patterns corresponding to the selecting position.

2. A pattern selecting device for an electronic sewing machine, comprising a pattern information memory which stores stitching pattern information about available patterns; an indication data memory which stores indicated groups of patterns corresponding to the patterns stored in the pattern information memory; a pattern indication means including a stored pattern indicating part which indicates the pattern groups read out from the indication data memory; a first pattern selecting member which effects selection of a desired pattern group to be indicated in the pattern indicating means; a second pattern selecting member which effects movement of a selected indication of a pattern from a selected pattern group; and a reading-out means for reading out the pattern of the selected indication in the pattern indication means.

3. A pattern selecting device for a electronic sewing machine, comprising a pattern information memory which stores stitching pattern information about available patterns; an indication data memory which stores, in a predetermined order, groups of patterns to be indicated corresponding to the patterns stored in the pattern information memory; a pattern indication means including a stored pattern indicating part which indicates the pattern groups read out from the indication data memory; a first pattern selecting member which effects selection of a pattern group to be indicated in the pattern indicating means; a second pattern selecting member which effects movement of selected indications of desired patterns from a selected pattern group to a selecting position of the stored pattern indicating part; and counting means for counting a length of a selected signal for effecting movement of a selected indication of a pattern by means of the second pattern selecting means to the selecting position so as to select the patterns according to a final count of the counting means.

4. The device as claimed in claim 1 further comprising a selecting means composed of a transparent touch panel having a plurality of selection detecting points located at positions corresponding to the areas on the pattern indication means where patterns are indicated.

5. The device as claimed in claim 1 wherein the liquid crystal indicating panel of the pattern indication means is provided with a window-indicating function for selectably indicating function information about different stitching patterns selected from the indication of available pattern groups by operating the transparent touch panel.

6. The device as claimed in claim 4 wherein the pattern indication means includes a liquid crystal indicating panel adjoining a rear side of said transparent touch panel.

* * * * *